United States Patent [19]

King et al.

[11] Patent Number: 4,697,589

[45] Date of Patent: Oct. 6, 1987

[54] INFANT PACIFIER STABILIZING DEVICE

[76] Inventors: Feather W. King; John R. King, both of 165 Reiten Dr., Ashland, Oreg. 97520

[21] Appl. No.: 861,921

[22] Filed: May 12, 1986

[51] Int. Cl.[4] ..... A61J 17/00

[52] U.S. Cl. ..... 128/359

[58] Field of Search ..... 128/359, 360; 273/58 F, 273/415; 5/449, 450, 441, 442, 455

[56] References Cited

U.S. PATENT DOCUMENTS 3,170,692 2/1965 Keosiff ..... 273/415 X 4,277,910 7/1981 Kramer ..... 128/360 X

*Primary Examiner*—Michael H. Thaler

*Attorney, Agent, or Firm*—Thomas M. Freiburger

[57] ABSTRACT

A stabilizing device for infant pacifiers is constructed of an elongated generally tubular bean bag, closed or closable at two locations to form a central and two outer bean bag sections. On the center section is a fabric tab for inserting through the ring of a pacifier and then securing to the bean bag with hook and loop fasteners. The bean bag sections lie on the infant's chest or shoulders or on a surface to retain the pacifier within reach even when it is not in the baby's mouth. With adjustment of the positions of the two outer bean bag chambers, a variety of configurations can be formed to stabilize the pacifier in different positions of the infant.

9 Claims, 6 Drawing Figures

INFANT PACIFIER STABILIZING DEVICE

BACKGROUND OF THE INVENTION

The invention relates to infant accessories, and specifically to a device for attachment to a pacifier to help retain it within reach of an infant.

An infant pacifier generally includes a nipple-simulating element for the baby's mouth, a shield, and a holding ring. These pacifiers, particularly as used by infants up to six months of age, are frequently dropped out of the baby's mouth and must be retrieved and put back into the mouth by an adult. If the pacifier falls on the floor, frequent washings are necessary.

Since babies under six months of age have limited tongue control and limited eye-hand coordination for retrieving a pacifier themselves, there has been a need for a dependable device for retaining a pacifier near a baby's mouth, within reach of the baby, so that after pushing the pacifier out of his or her mouth, the baby can again reach the pacifier merely by a small movement of the head.

In the prior art, some toys have included baby doll pacifiers with some form of restraint or connection for keeping them attached to the doll near the head. U.S. Pat. No. 4,204,362 generally shows such a toy. However, nothing in the prior art has provided a simply constructed and versatile pacifier holding and stabilizing device useable by infants as does the present invention described below.

SUMMARY OF THE INVENTION

In accordance with the invention, a stabilizing device for an infant pacifier, particularly for infants from about two weeks to six months of age, comprises a bean bag, preferably elongated and generally tubular in shape. To the bean bag is connected a tab or appendage which is insertable through the typical ring of a pacifier and capable of securing to the bean bag using a suitable quick-release fastening element, such as hook and loop Velcro fasteners.

A preferred feature of the pacifier holding apparatus of this invention is that the bean bag is divided into multiple segments or chambers, preferably three. This enables the bean chambers to be positioned in various configurations to hold the pacifier at the baby's mouth for various positions of the baby.

It is therefore among the objects of the invention to provide a simple and effective infant accessory for retaining a pacifieer near the mouth of the baby so that less attention is required from an adult with respect to retrieving the pacifier and cleaning it after dropping to the floor. These and other objects, advantages, features and characteristics of the invention will be apparent from the following description of a preferred embodiment, considered along with the accompanying drawings.

DESCRIPTION OF A PREFERRED EMBODIMENT

Figure 1:
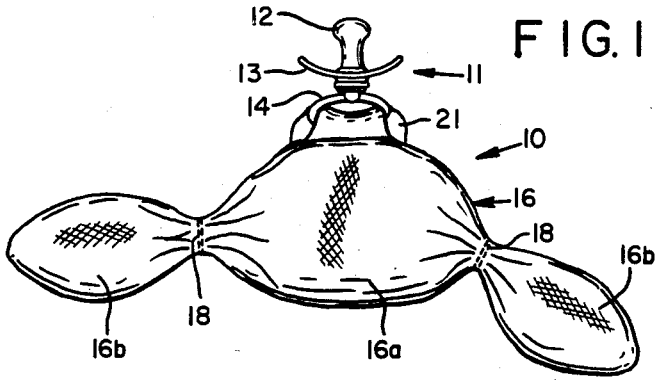
FIG. 1 shows a preferred embodiment of an infant pacifier holding and stabilizing device in accordance with the principles of the invention.

In the drawings, FIG. 1 shows a pacifier holding and stabilizing device generally identified by the reference number 10, as secured to a pacifier 11 of typical configuration. The pacifier 11 may be of the type sold under the trademark Nuk, as disclosed, for example, in U.S. Pat. No. 4,381,785. The pacifier includes a nipple-simulating element 12, a generally cup-shaped shield 13, and a holding ring 14 which may be pivotally connected to the back of the shield 13.

The pacifier stabilizing device 10 preferably comprises a bean bag 16, containing a large number of washable beans or bean-like elements 17 (FIG. 2), so that the device can mold to the contour of the baby's chest or shoulders or any other surface on which it lies, to very stably stay in place and to thereby hold the pacifier 11 in a desired position near the baby's mouth.

The bean bag 16 preferably comprises an elongated generally tubular bag which may be formed of soft woven fabric. Preferably there is included stitching 18 to divide the bean bag 16 into separate segments or bean chambers **16*a* and 16*b*. In the preferred embodiment the beans are segregated into a central bean chamber 16*a* and two outer bean chambers 16*b***.

Also shown in the drawings is a tab or appendage 21 which is provided to secure the pacifier 11 to the bean bag device 10. This tab or appendage 21 may comprise a generally flat piece of fabric, which may be stitched generally centrally to the top edge of the bean bag 16, connected at or near a top seam 19. The securing of the tab 21 with the seam 19 adds strength to the connection.

Figure 2:
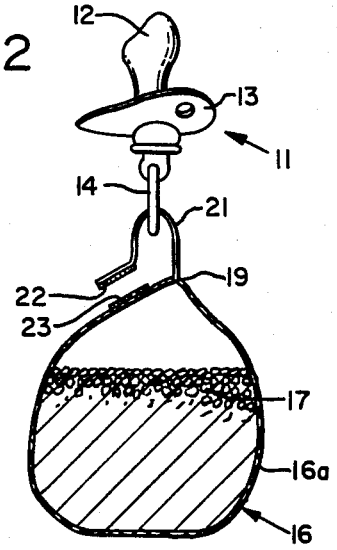
FIG. 2 is a transverse sectional view of the pacifier holding device.

The tab is shown inserted through the ring element 14 of the pacifier 11. After first being inserted through the ring as shown in FIG. 2, the tab is then secured to itself or to the bean bag 16 to prevent its slipping out of the ring 14. This may be accomplished by hook and loop fasteners 22 and 23 (or "Velcro") indicated somewhat schematically in FIG. 2. One element of the fasteners 22 and 23 is secured, as by stitching, to the underside of the tab 21 near its end. The other hook or loop fastener element 23 may be secured to the outside surface of the bean bag 16, just below the connection of the tab 21 with the bean bag body. The locations of the hool and loop elements are interchangeable.

In this way, the pacifier 11 is readily connected to the stabilizing device 10 of the invention and is easily releasable. The use of the hook and loop fasteners is preferable for making a secure connection which is easily released, the connecting elements being washable along with the rest of the device 10, but other suitable fasteners such as snaps or buttons may alternatively be used.

The bean-like elements 17 within the bag are also selected so as to enable washing and drying in the conventional manner.

Figure 3:
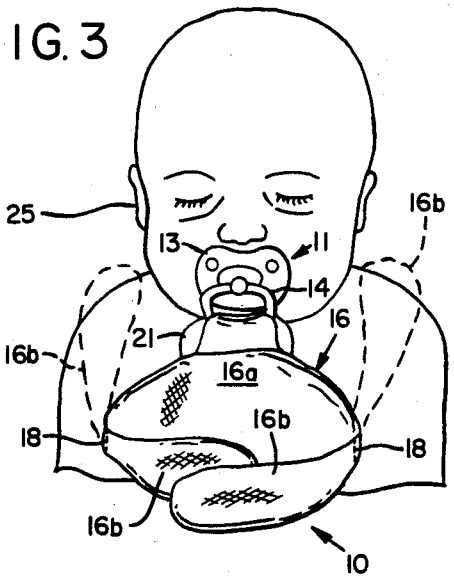
FIG. 3 is a view showing the device as used for an infant, with the infant lying flat on his back and the pacifier holding device in an appropriate configuration for this infant position.
Figure 4:
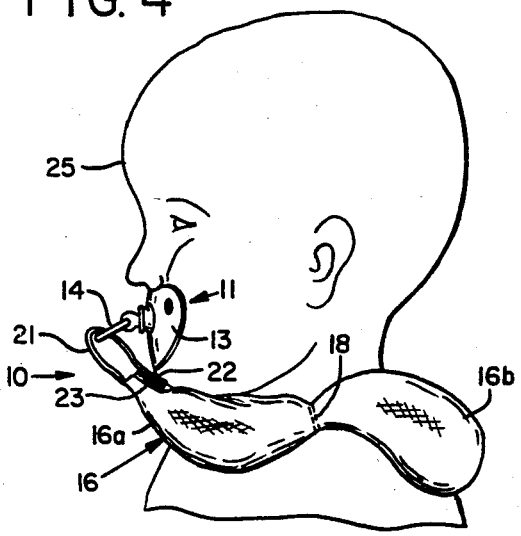
FIG. 4 is a view showing the infant sitting up, with the pacifier holding device extending partially over the shoulders to hold the pacifier appropriately for this position.
Figure 5:
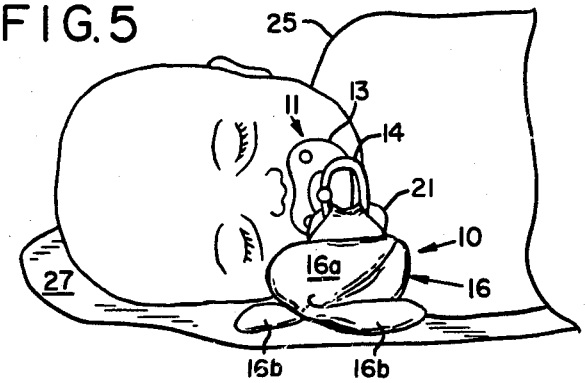
FIG. 5 is a view showing the use of the pacifier holder device of the invention with the infant lying on his side.

FIGS. 3, 4 and 5 show different positions of an infant 25 making use of the device 10 of the invention to retain the pacifier 11 near the mouth of the infant. As mentioned above, the infant most preferably is in the range of about two weeks to about six months, when muscle control and manual dexterity are not well developed.

In FIG. 3, the baby is lying flat on his back or sitting reclined as in a baby seat such as a cradle carrier, and the pacifier holding device 10 of the invention is positioned on the chest with the two outer bean chambers 16*b* tucked or folded up against the central or main bean chamber 16*a*. This gives stability by placing the outer bean bag segments 16*b* below (with respect to the baby's height) the main chamber, to help hold the main chamber 16*a* and the pacifier 11 stably in the desired position for this prone position of the baby. Alternatively, as shown in dashed lines in FIG. 3, the outer bag segments 16*b* may lie on or over the shoulders for stability in this position.

FIG. 4 shows the baby sitting up, with the device 10 positioned near the neck and with the two outer bean chambers 16*b* lying on and extending partially over the baby's shoulders. This configuration of the pacifier retaining device 10 is best for the sitting position.

In FIG. 5, the baby is shown lying on his side. The device 10 of the invention is in a somewhat twisted or generally helical position as indicated, to keep the pacifier 11 at an elevated position near the baby's mouth. Thus, the two outer bean chambers 16*b* are stably resting against a bed or other horizontal surface 27, the two chambers being adjacent to one another, while the central or main bean chamber 16*a* sits on top of the two outer chambers, keeping the main chamber 16*a* and the pacifier 11 at an elevated position for the baby and also further stabilizing the position of the two outer chambers 16*b* by forming a bean bag mass held together primarily by friction.

Figure 6:
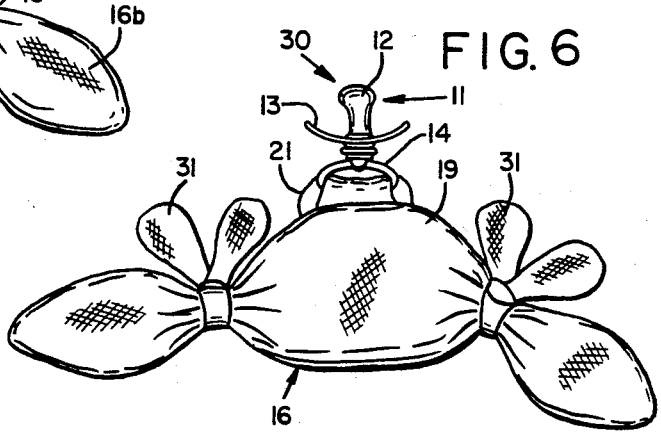
FIG. 6 shows a modified form of the pacifier holding device.

FIG. 6 shows another embodiment 30 of the invention wherein the division of the bean bag into separate bean chambers is releasable. This may be accomplished by releasable ties 31 as shown in the drawings. The bean bag 16 preferably is capable of division into three separate chambers as in the first embodiment, so that two sets of ties 31 are provided.

At each division location, a pair of ties 31 may extend from the location of the top seam 19 of the bean bag, so that the base ends of the ties 31 are secured by stitching at or approximately at the location of the seam 19. Connection at the seam 19 is preferable for strength.

In FIG. 1 the ties 31 have been drawn around the body of the bean bag 16 and tied together to segregate the beans into a central bean chamber and two outer chambers as in the embodiment described above. The ties 31, which may be in any suitable form, preferably comprise fabric tabs or flaps, which may be similar to the fabric of the bean bag body 16. A very simple knot will adequately secure them together, due to the friction inherent in the tied fabric.

Like the pacifier retaining tab 21, the ties 31 may also employ Velcro (or other fasteners) in lieu of tying them together. They may then be shorter in length, and only one tie need be provided at each division point. Accordingly, the word "tie" as used in the claims is intended to refer to strings or fabric appendages for closing off the bag, whether these elements are actually tied or not and whether or not they include fastening devices.

The entire stabilizing device 10 of the invention is washable in the preferred constructions, and the releasable ties 31 enable the bean bag 16 to be thoroughly washed and dried easily, by releasing them for washing and drying so that dirt or moisture will not be trapped in close places and compressed between multiple layers of fabric. The ties 31 also enable the beans to be distributed in any selected manner among the different chambers formed when the ties are secured around the bag.

The above-described preferred embodiment is intended to illustrate the principles of the invention, but not to limit its scope. Other embodiments and variations to this preferred embodiment will be apparent to those skilled in the art and may be made without departing from the scope of the invention as defined in the following claims.

I claim:

1. In combination with an infant pacifier having a holding ring, an infant pacifier stabilizing device, comprising:

a bean bag comprising a flexible bag containing bean-like members and having the character of being loose and pliable and easily shapeable into different configurations;

a flexible appendage secured to and extending from the bean bag in a generally central location, with a fixed end secured to the bean bag and a free end inserted through the ring of the infant pacifier, and including means for fastening the appendage to retain the appendage on the pacifier ring; and means for adjusting the configuration of the bean bag and for maintaining it in an adjusted position to accommodate different positions of the infant while generally keeping the pacifier within reach of the infant's mouth.

2. The claim 1, wherein the fastening means for the appendage comprises hook and loop fasteners.

3. The claim 1, wherein the means for adjusting the bean bag includes segmenting means for dividing the bean bag into three separate bean chambers, adjustable in position with respect to one another.

4. The claim 1, wherein the bag is generally tubular, and includiing segmenting means for dividing the bean bag into a plurality of bean chambers.

5. The claim 4, wherein the segmenting means comprises stitching closing the tubular bag at two locations on the bag.

6. The claim 4, wherein the segmenting means comprises at least one flexible tie connected to the tubular bag and positioned to permit the tie to encircle the bag and close it off to divide it into different chambers with the bean-like members distributed between the chambers as desired.

7. The of claim 6, wherein two ties are included, positioned to divide the tubular bag into three bean chambers, a central chamber and two outer chambers.

8. An infant pacifier stabilizing device for connection to the holding ring of an infant pacifier, for placement on the infant's chest and shoulders to keep the pacifier within reach of the baby's mouth, comprising:

a generally elongated bean bag comprising a generally tubular bag containing a large number of bean-like members and having the character of being loose and pliable and easily shapeable into different configurations;

means on the bag for dividing the bean bag into a plurality of separate bean chambers, so that the separate chambers can be positioned in various configurations; and a flexible appendage extending from the bag and having means for insertion through the holding ring of the pacifier, and means associated with the appendage for securing it to the bag to retain the holding ring to the bean bag.

9. The infant pacifier stabilizing device of claim 8, wherein the means for dividing the bag comprises flexible tie means for selectively dividing the bag into said separate chambers, so that the bean-like members can be shifted between the different chambers and the chambers may be tied off with the bean-like members distributed as desired.

* * * * *